US012687296B2

(12) United States Patent
McCaffrey et al.

(10) Patent No.: US 12,687,296 B2
(45) Date of Patent: Jul. 21, 2026

(54) SEPARATING AIRFLOWS WITHIN A TURBINE ENGINE

(71) Applicant: RTX Corporation, Farmington, CT (US)

(72) Inventors: Michael G. McCaffrey, Windsor, CT (US); Daniel B. Kupratis, Wallingford, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/400,388

(22) Filed: Dec. 29, 2023

(65) Prior Publication Data

US 2025/0216078 A1 Jul. 3, 2025

(51) Int. Cl.
*F23R 3/06* (2006.01)
*F23R 3/00* (2006.01)

(52) U.S. Cl.
CPC ..... *F23R 3/002* (2013.01); *F23R 3/06* (2013.01)

(58) Field of Classification Search
CPC .... F02C 7/05; F02C 7/052; F23R 3/26; F23R 3/04; F23R 3/045; F23R 3/002; F23R 3/06
See application file for complete search history.

(56) References Cited

U.S. PATENT DOCUMENTS 5,619,855 A 4/1997 Burrus
6,308,511 B1 * 10/2001 Beeck ..... F01D 5/187 415/115
6,651,439 B2 * 11/2003 Al-Roub ..... F23R 3/04 60/751
7,827,799 B2 11/2010 O'Neill
12,313,000 B1 * 5/2025 Hanrahan ..... F02C 7/052
12,359,615 B1 * 7/2025 McCaffrey ..... F23R 3/04
2006/0162336 A1 7/2006 Cayre
2012/0233973 A1 9/2012 Sedillo
2014/0260289 A1 9/2014 Graves
2015/0345331 A1 * 12/2015 Murray ..... F01D 25/24 60/785
2015/0354461 A1 * 12/2015 Meier ..... F01D 5/081 60/726
2016/0003477 A1 1/2016 Propheter-Hinckley et al.
(Continued)

OTHER PUBLICATIONS

EP Search Report for EP Patent Application No. 24223762.6 dated Apr. 2, 2025.

*Primary Examiner* — Thomas P Burke
(74) *Attorney, Agent, or Firm* — Getz Balich LLC

(57) ABSTRACT

An assembly is provided for a turbine engine. This assembly includes an engine core extending along an axis. The engine core includes a compressor section, a combustor, a diffuser structure, a diffuser plenum and a separator. The combustor is arranged within the diffuser plenum. The combustor includes a combustion chamber and a combustor wall between the combustion chamber and the diffuser plenum. The combustor wall includes a dilution aperture extending through the combustor wall to the combustion chamber. The diffuser structure includes a first diffuser passage and a second diffuser passage radially offset from the first diffuser passage. The first diffuser passage fluidly couples the compressor section to the diffuser plenum. The second diffuser passage fluidly couples the compressor section to the separator. The separator fluidly couples the second diffuser passage to the dilution aperture.

16 Claims, 9 Drawing Sheets

(56) References Cited

U.S. PATENT DOCUMENTS

| | | | | |
|---|---|---|---|---|
| 2017/0058775 | A1* | 3/2017 | Patel | F23R 3/002 |
| 2018/0021711 | A1* | 1/2018 | Mook | B01D 45/08 95/269 |
| 2018/0209284 | A1* | 7/2018 | Day | F01D 25/32 |
| 2019/0264616 | A1 | 8/2019 | Lovett | |
| 2020/0393129 | A1* | 12/2020 | Duong | F01D 17/14 |
| 2022/0373181 | A1 | 11/2022 | Zelina | |
| 2023/0072621 | A1* | 3/2023 | Swann | F23R 3/06 |
| 2025/0334075 | A1* | 10/2025 | Hanrahan | B01D 45/16 |

* cited by examiner

SEPARATING AIRFLOWS WITHIN A TURBINE ENGINE

BACKGROUND OF THE DISCLOSURE

1. Technical Field

This disclosure relates generally to an aircraft and, more particularly, to separating airflows within an aircraft engine.

2. Background Information

Various systems and methods are known in the art for separating airflows within an aircraft engine. While these known systems and methods have various benefits, there is still room in the art for improvement.

SUMMARY OF THE DISCLOSURE

According to an aspect of the present disclosure, an assembly is provided for a turbine engine. This assembly includes an engine core extending along an axis. The engine core includes a compressor section, a combustor, a diffuser structure, a diffuser plenum and a separator. The combustor is arranged within the diffuser plenum. The combustor includes a combustion chamber and a combustor wall between the combustion chamber and the diffuser plenum. The combustor wall includes a dilution aperture extending through the combustor wall to the combustion chamber. The diffuser structure includes a first diffuser passage and a second diffuser passage radially offset from the first diffuser passage. The first diffuser passage fluidly couples the compressor section to the diffuser plenum. The second diffuser passage fluidly couples the compressor section to the separator. The separator fluidly couples the second diffuser passage to the dilution aperture.

According to another aspect of the present disclosure, another assembly is provided for a turbine engine. This assembly includes an engine core extending along an axis. The engine core includes a compressor section, a combustor, a diffuser structure, a diffuser plenum and an air-debris separator. The combustor is arranged within the diffuser plenum. The diffuser structure includes a first diffuser passage and a second diffuser passage radially offset from the first diffuser passage. The first diffuser passage extends from and fluidly couples the compressor section to the diffuser plenum. The second diffuser passage extends from and fluidly couples the compressor section to the air-debris separator. The air-debris separator is arranged within the diffuser plenum and radially next to the combustor.

According to still another aspect of the present disclosure, a method of operation is provided for a turbine engine. This method includes: compressing core air with a compressor section to provide compressed core air; directing a first portion of the compressed core air into a diffuser plenum surrounding a combustor; directing a second portion of the compressed core air into a separator; separating the second portion of the compressed core air within the separator into a first airflow and a second airflow carrying debris; directing the first airflow out of the separator into the diffuser plenum; and directing the second airflow carrying the debris out of the separator into a combustion chamber within the combustor.

The air-debris separator may be configured to separate compressed core air received from the compressor section into a clean airflow and a dirty airflow. The air-debris separator may be configured to direct the clean airflow into the diffuser plenum. The air-debris separator may be configured to direct the dirty airflow into a combustion chamber of the combustor.

The engine core may also include a turbine section comprising a circumferential stator vane array. The combustor wall may be connected to the circumferential stator vane array.

The separator may be arranged within the diffuser plenum radially next to the combustor wall.

The separator may be configured as or otherwise include a cyclonic separator.

The separator may be configured to separate compressed core air received from the compressor section into a first airflow and a second airflow. The separator may be configured to direct the first airflow into the diffuser plenum. The separator may be configured to direct the second airflow into the combustion chamber through the dilution aperture.

When the compressed core air received by the separator from the compressor section includes debris, the separator may be configured to divert at least a majority of the debris away from the first airflow and into the second airflow to flow with the second airflow into the combustion chamber through the dilution aperture.

The separator may include a center body, an inner tube, an outer tube, a first airflow passage and a second airflow passage. An upstream portion of the center body may extend longitudinally in a bore of the outer tube. A downstream portion of the center body may project longitudinally into a bore of the inner tube. The outer tube may extend longitudinally along and may circumscribe the inner tube. The first airflow passage may be formed within the inner tube. The second airflow passage may be formed between the inner tube and the outer tube. The second airflow passage may be fluidly coupled to the dilution aperture.

The first airflow passage may be fluidly coupled to the diffuser plenum.

The separator may also include one or more vanes connecting the center body to the outer tube.

The separator may also include one or more vanes connecting the center body to the inner tube.

The second diffuser passage may be disposed radially outboard of the first diffuser passage.

The second diffuser passage may be disposed radially inboard of the first diffuser passage.

The first diffuser passage may be configured as or otherwise include an annular passage. The second diffuser passage may be configured as or otherwise include a non-annular passage.

The separator may be a first separator. The engine core may also include a second separator. The dilution aperture may be a first dilution aperture. The combustor wall may also include a second dilution aperture extending through the combustor wall to the combustion chamber. The diffuser structure may also include a third diffuser passage radially offset from the first diffuser passage and radially aligned with the second diffuser passage. The third diffuser passage may fluidly couple the compressor section to the second separator. The second separator may fluidly couple the third diffuser passage to the second dilution aperture.

The separator may be a first separator. The engine core may also include a second separator. The combustor wall may be a first combustor wall. The combustor may also include a second combustor wall with the combustion chamber extending radially between the first combustor wall and the second combustor wall. The dilution aperture may be a first dilution aperture. The second combustor wall may include a second dilution aperture extending through the second combustor wall to the combustion chamber. The diffuser structure may also include a third diffuser passage radially offset from the first diffuser passage and the second diffuser passage. The third diffuser passage may fluidly couple the compressor section to the second separator. The second separator may fluidly couple the third diffuser passage to the second dilution aperture.

The first diffuser passage may be located radially between the second diffuser passage and the third diffuser passage.

The compressor section may be configured as or otherwise include an axial flow compressor rotor upstream of and next to the diffuser structure.

The compressor section may be configured to direct compressed core air into the diffuser structure with (A) a Mach number equal to or greater than 0.5 Mach at an inlet into the diffuser structure and/or (B) a Mach number equal to or greater than 0.2 Mach at an outlet from the diffuser structure.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
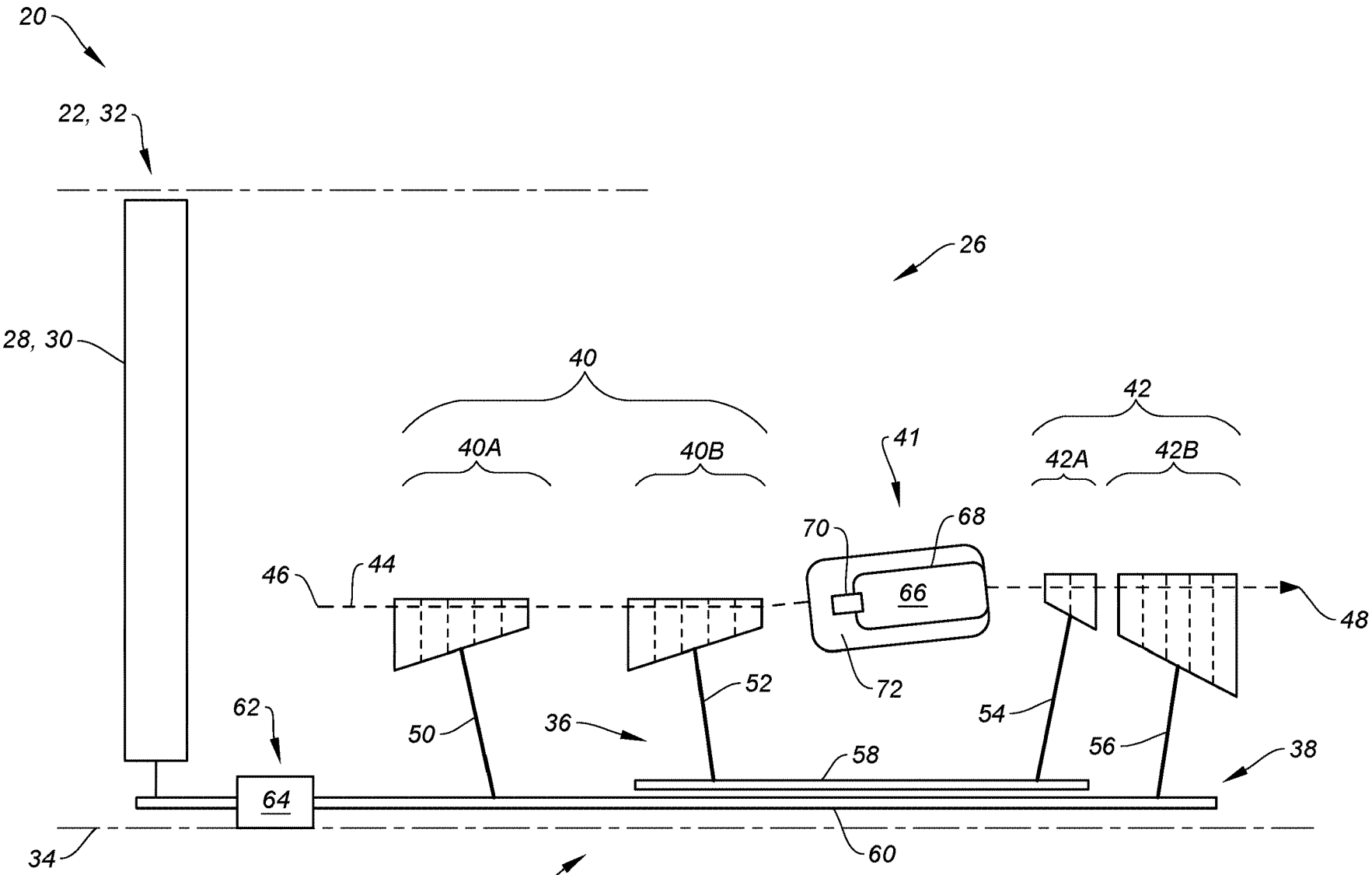
FIG. 1 is a partial schematic illustration of an aircraft system.

FIG. 1 illustrates a system 20 for an aircraft. The aircraft may be an airplane, a helicopter, a drone (e.g., an unmanned aerial vehicle (UAV)) or any other manned or unmanned aerial vehicle or system. The aircraft system 20 may be configured as, or otherwise included as part of, a propulsion system for the aircraft. The aircraft system 20 may also or alternatively be configured as, or otherwise included as part of, an electrical power system for the aircraft. The aircraft system 20 of FIG. 1 includes a mechanical load 22 and a core 24 of a turbine engine 26.

The mechanical load 22 may be configured as or otherwise include a rotor 28 mechanically driven and/or otherwise powered by the engine core 24. This driven rotor 28 may be a bladed propulsor rotor 30 (e.g., an air mover) where the aircraft system 20 is (or is part of) the aircraft propulsion system. The propulsor rotor 30 includes a plurality of rotor blades arranged circumferentially around and connected to a rotor disk or hub. The propulsor rotor 30 may be an open (e.g., un-ducted) propulsor rotor or a ducted propulsor rotor. Examples of the open propulsor rotor include a propeller rotor for a turboprop propulsion system, a rotorcraft rotor (e.g., a main helicopter rotor) for a turboshaft propulsion system, a propfan rotor for a propfan propulsion system, and a pusher fan rotor for a pusher fan propulsion system. An example of the ducted propulsor rotor is a fan rotor for a turbofan propulsion system. The present disclosure, of course, is not limited to the foregoing exemplary propulsor rotor arrangements. Moreover, the driven rotor 28 may alternatively be a generator rotor of an electric power generator where the aircraft system 20 is (or is part of) the aircraft power system; e.g., an auxiliary power unit (APU) for the aircraft. However, for ease of description, the mechanical load 22 may be generally described below as a propulsor section 32 of the turbine engine 26 and the driven rotor 28 may be generally described as the propulsor rotor 30 within the propulsor section 32.

The engine core 24 extends axially along an axis 34 between an upstream, forward end of the engine core 24 and a downstream, aft end of the engine core 24. This axis 34 may be a centerline axis of the turbine engine 26 and/or its engine core 24. The axis 34 may also or alternatively be a rotational axis of one or more rotating assemblies (e.g., 36 and 38) of the turbine engine 26 and its engine core 24. The engine core 24 includes a compressor section 40, a combustor section 41, a turbine section 42 and a core flowpath 44. The compressor section 40 of FIG. 1 includes a low pressure compressor (LPC) section 40A and a high pressure compressor (HPC) section 40B. The turbine section 42 of FIG. 1 includes a high pressure turbine (HPT) section 42A and a low pressure turbine (LPT) section 42B. The core flowpath 44 extends sequentially through the LPC section 40A, the HPC section 40B, the combustor section 41, the HPT section 42A and the LPT section 42B from an airflow inlet 46 into the core flowpath 44 to a combustion products exhaust 48 from the core flowpath 44. The core inlet 46 may be disposed at (e.g., on, adjacent or proximate) the forward end of the engine core 24, and the core exhaust 48 may be disposed at the aft end of the engine core 24.

The LPC section 40A includes a bladed low pressure compressor (LPC) rotor 50. The LPC rotor 50 includes one or more sets of compressor blades (schematically shown) arranged circumferentially around one or more rotor disks, where the compressor blades in each set are connected to and project out from a respective one of the rotor disks. Here, the LPC rotor 50 and its multiple sets of the compressor blades provide the LPC section 40A with multiple compressor stages. Each of these compressor stages may be configured as an axial flow compressor stage, and the LPC rotor 50 may be configured as an axial flow compressor rotor. Herein, the term "axial flow" may describe a rotor stage and/or a rotor which (A) receives an incoming flow along a trajectory with an axial component and without a (or with a very small) radial component and (B) outputs an outgoing flow along a trajectory with an axial component and without a (or with a very small) radial component. The LPC rotor 50 of FIG. 1 is disposed in and arranged longitudinally along the core flowpath 44 between the core inlet 46 and the HPC section 40B. The compressor blades, for example, are disposed in and extend across the core flowpath 44. Each rotor disk is disposed adjacent (e.g., radially below) the core flowpath 44. The present disclosure, however, is not limited to such an exemplary LPC rotor configuration.

The HPC section 40B includes a bladed high pressure compressor (HPC) rotor 52. The HPC rotor 52 includes one or more sets of compressor blades (schematically shown) arranged circumferentially around one or more rotor disks, where the compressor blades in each set are connected to and project out from a respective one of the rotor disks. Here, the HPC rotor 52 and its multiple sets of the compressor blades provide the HPC section 40B with multiple compressor stages. Each of these compressor stages may be configured as an axial flow compressor stage, and the HPC rotor 52 may be configured as an axial flow compressor rotor. The HPC rotor 52 is disposed in and arranged longitudinally along the core flowpath 44 between the LPC section 40A and the combustor section 41. The compressor blades, for example, are disposed in and extend across the core flowpath 44. Each rotor disk is disposed adjacent (e.g., radially below) the core flowpath 44. The present disclosure, however, is not limited to such an exemplary HPC rotor configuration.

The HPT section 42A includes a bladed high pressure turbine (HPT) rotor 54. The HPT rotor 54 includes one or more sets of turbine blades (schematically shown) arranged circumferentially around one or more rotor disks, where the turbine blades in each set are connected to and project out from a respective one of the rotor disks. Here, the HPT rotor 54 and its multiple sets of the turbine blades provide the HPT section 42A with multiple turbine stages. Each of these turbine stages may be configured as an axial flow turbine stage, and the HPT rotor 54 may be configured as an axial flow turbine rotor. The HPT rotor 54 is disposed in and arranged longitudinally along the core flowpath 44 between the combustor section 41 and the LPT section 42B. The turbine blades, for example, are disposed in and extend across the core flowpath 44. Each rotor disk is disposed adjacent (e.g., radially below) the core flowpath 44. The present disclosure, however, is not limited to such an exemplary HPT rotor configuration.

The LPT section 42B includes a bladed low pressure turbine (LPT) rotor 56. The LPT rotor 56 includes one or more sets of turbine blades (schematically shown) arranged circumferentially around one or more rotor disks, where the turbine blades in each set are connected to and project out from a respective one of the rotor disks. Here, the LPT rotor 56 and its multiple sets of the turbine blades provide the LPT section 42B with multiple turbine stages. Each of these turbine stages may be configured as an axial flow turbine stage, and the LPT rotor 56 may be configured as an axial flow turbine rotor. The LPT rotor 56 is disposed in and arranged longitudinally along the core flowpath 44 between the HPT section 42A and the core exhaust 48. The turbine blades, for example, are disposed in and extend across the core flowpath 44. Each rotor disk is disposed adjacent (e.g., radially below) the core flowpath 44. The present disclosure, however, is not limited to such an exemplary LPT rotor configuration.

The HPC rotor 52 is coupled to and rotatable with the HPT rotor 54. The HPC rotor 52 of FIG. 1, for example, is connected to the HPT rotor 54 by a high speed shaft 58. At least (or only) the HPC rotor 52, the HPT rotor 54 and the high speed shaft 58 collectively form the high speed rotating assembly 36; e.g., a high speed spool of the engine core 24. The LPC rotor 50 is coupled to and rotatable with the LPT rotor 56. The LPC rotor 50 of FIG. 1, for example, is connected to the LPT rotor 56 by a low speed shaft 60. At least (or only) the LPC rotor 50, the LPT rotor 56 and the low speed shaft 60 collectively form the low speed rotating assembly 38; e.g., a low speed spool of the engine core 24. This low speed rotating assembly 38 is further coupled to the driven rotor 28 (e.g., the propulsor rotor 30) through a drivetrain 62. The drivetrain 62 may be configured as a geared drivetrain, where a geartrain 64 (e.g., a transmission, a speed change device, an epicyclic geartrain, etc.) is disposed between and operatively couples the driven rotor 28 to the low speed rotating assembly 38 and its LPT rotor 56. With this arrangement, the driven rotor 28 may rotate at a different (e.g., slower) rotational velocity than the low speed rotating assembly 38 and its LPT rotor 56. However, the drivetrain 62 may alternatively be configured as a direct drive drivetrain, where the geartrain 64 is omitted. With this arrangement, the driven rotor 28 rotates at a common (the same) rotational velocity as the low speed rotating assembly 38 and its LPT rotor 56. Referring again to FIG. 1, each of the rotating assemblies 36, 38 and its members may be rotatable about the axis 34.

During operation of the turbine engine 26, air may be directed across the driven rotor 28 (e.g., the propulsor rotor 30) and into the engine core 24 through the core inlet 46. This air entering the core flowpath 44 may be referred to as "core air". The core air is compressed by the LPC rotor 50 and the HPC rotor 52 and directed into a combustion chamber 66 (e.g., an annular combustion chamber) within a combustor 68 (e.g., an annular combustor) of the combustor section 41. Fuel is injected into the combustion chamber 66 by one or more fuel injectors 70 and mixed with the compressed core air to provide a fuel-air mixture. This fuel-air mixture is ignited and combustion products thereof flow through and sequentially drive rotation of the HPT rotor 54 and the LPT rotor 56 about the axis 34. The rotation of the HPT rotor 54 and the LPT rotor 56 respective drive rotation of the HPC rotor 52 and the LPC rotor 50 and, thus, the compression of the air received from the core inlet 46. The rotation of the LPT rotor 56 also drives rotation of the driven rotor 28. Where the driven rotor 28 is configured as the propulsor rotor 30, the rotation of that propulsor rotor 30 may propel additional air (e.g., outside air, bypass air, etc.) outside of the engine core 24 to provide aircraft thrust and/or lift. Where the driven rotor 28 is configured as the generator rotor, the rotation of that generator rotor may facilitate generation of electricity.

Figure 2:
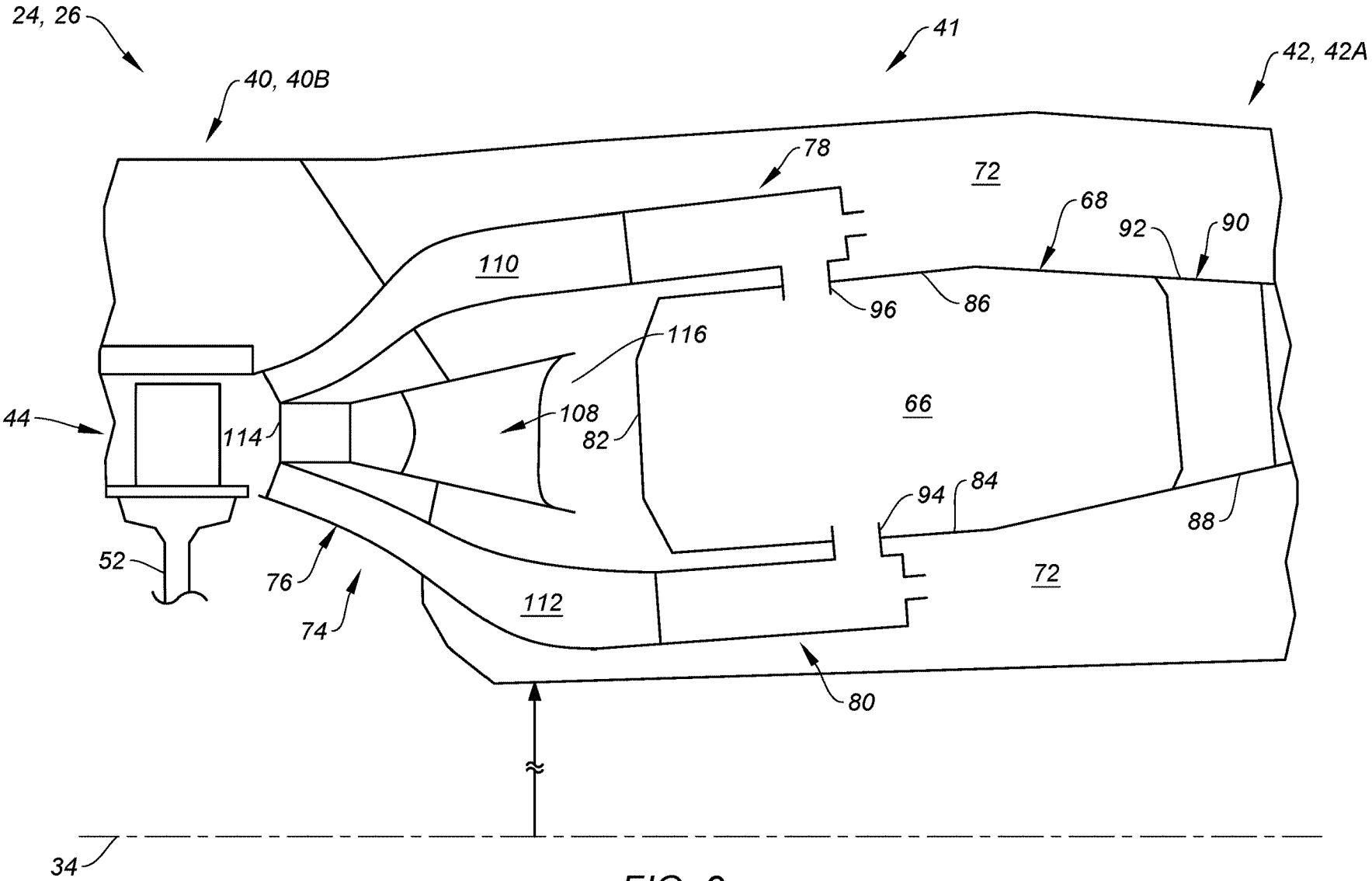
FIG. 2 is a schematic illustration of a portion of the aircraft system between a compressor section and a turbine section.

FIG. 2 illustrates a portion of the turbine engine 26 between (A) the compressor section 40 and its HPC section 40B and (B) the turbine section 42 and its HPT section 42A. Within this portion of the turbine engine 26, the combustor 68 is disposed within a diffuser plenum 72 and an air separation system 74 fluidly couples the HPC section 40B to the combustor 68 and the surrounding diffuser plenum 72. This air separation system 74 of FIG. 2 includes a diffuser structure 76, one or more outer air-debris separators 78 ("outer separators") and one or more inner air-debris separators 80 ("inner separators"). The air separation system 74 is described below with an even number of the outer separators 78 and an even number of the inner separators 80.

The combustor 68 of FIG. 2 includes an annular combustor bulkhead wall 82, a circumferential inner combustor wall 84, and a circumferential outer combustor wall 86. The bulkhead wall 82 of FIG. 2 extends radially between and to the inner combustor wall 84 and the outer combustor wall 86. The bulkhead wall 82 may be connected (e.g., mechanically fastened or otherwise attached) to the inner combustor wall 84 and/or the outer combustor wall 86. Each combustor wall 84, 86 projects axially along the axis 34 out from the bulkhead wall 82 towards the HPT section 42A. The inner combustor wall 84 of FIG. 2, for example, projects axially to and may be connected to an inner platform 88 of a downstream circumferential stator vane array 90 (e.g., a turbine inlet nozzle) in the HPT section 42A. The outer combustor wall 86 of FIG. 2 projects axially to and may be connected to an outer platform 92 of the downstream circumferential stator vane array 90. The combustion chamber 66 is thereby formed by and extends radially within the combustor 68 between and to the inner combustor wall 84 and the outer combustor wall 86. The combustion chamber 66 is formed by and extends axially (in an upstream direction along the core flowpath 44) into the combustor 68 from the circumferential stator vane array 90 to the bulkhead wall 82. The combustion chamber 66 also extends within the combustor 68 circumferentially about (e.g., completely around) the axis 34. With this arrangement, each wall 82, 84, 86 of the combustor 68 is disposed between, forms a peripheral boundary of and fluidly separates the combustion chamber 66 and the diffuser plenum 72.

Figure 3:
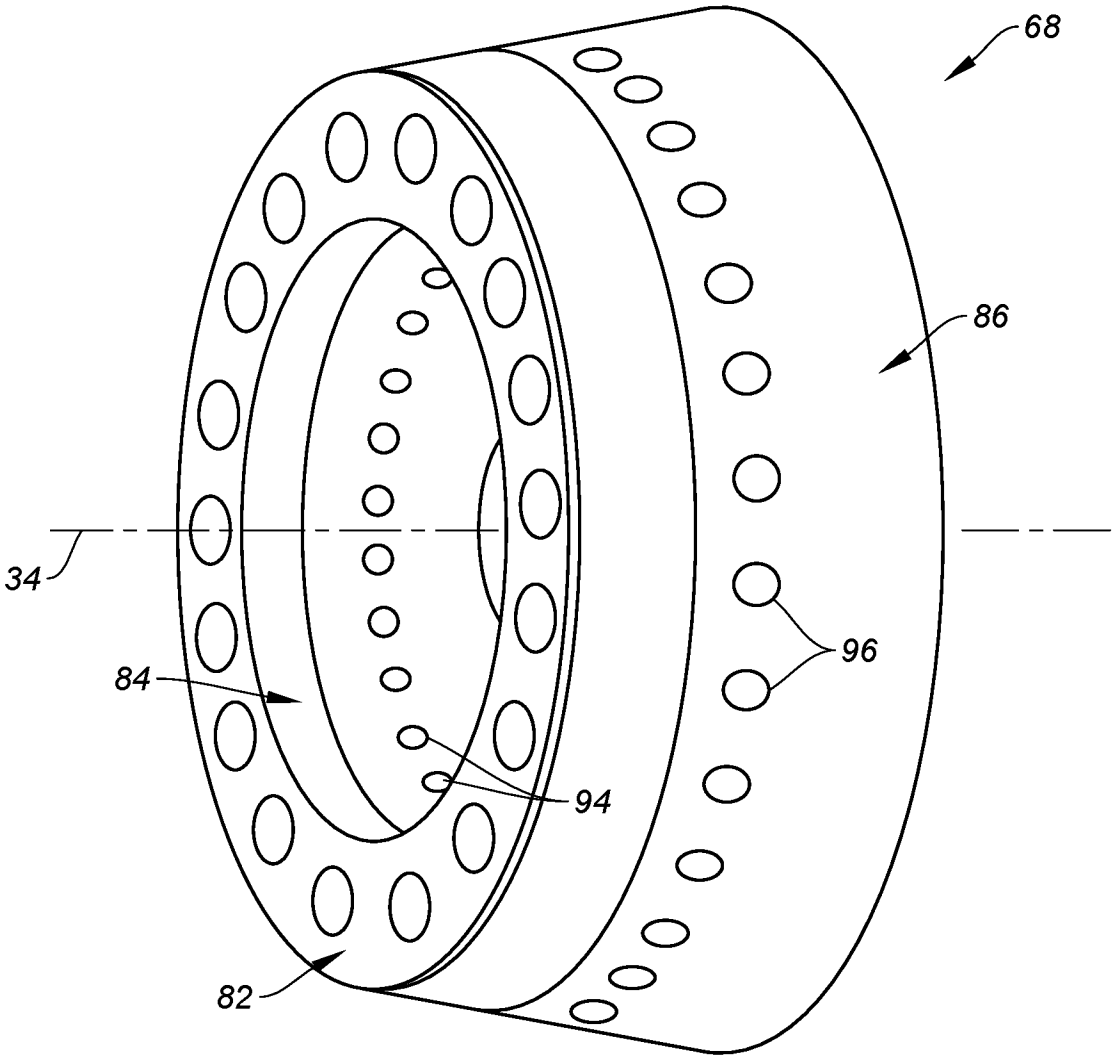
FIG. 3 is a perspective schematic illustration of a combustor.

Referring to FIG. 3, each combustor wall 84, 86 may include one or more dilution apertures 94, 96 (e.g., quench apertures) arranged circumferentially about the axis 34 in an array; e.g., a circular array. Referring to FIG. 2, each dilution aperture 94, 96 extends (e.g., radially) through the respective combustor wall 84, 86 to the combustion chamber 66. Each combustor wall 84, 86 may also include (or may not include) one or more cooling apertures (not shown for clarity of illustration); e.g., effusion aperture, cooling slots, etc. and may direct compressed air into the combustion chamber 66. By contrast to the dilution apertures 94, 96, each cooling aperture may have a flow area (e.g., a cross-sectional area) which is significantly smaller than (e.g., 5×, 10×, 15×, 20× smaller than) a flow area (e.g., a cross-sectional area) of each dilution aperture 94, 96. Moreover, whereas the cooling apertures (when provided) are configured to facilitate cooling (e.g., film cooling) of a hot side of the respective combustor wall 84, 86, the dilution apertures 94, 96 may be provided to tune combustion of the fuel-air mixture within the combustion chamber 66. The dilution apertures 94, 96, for example, may direct compressed air into the combustion chamber 66 to stoichiometrically lean (e.g., quench) the combustion products.

Figure 4:
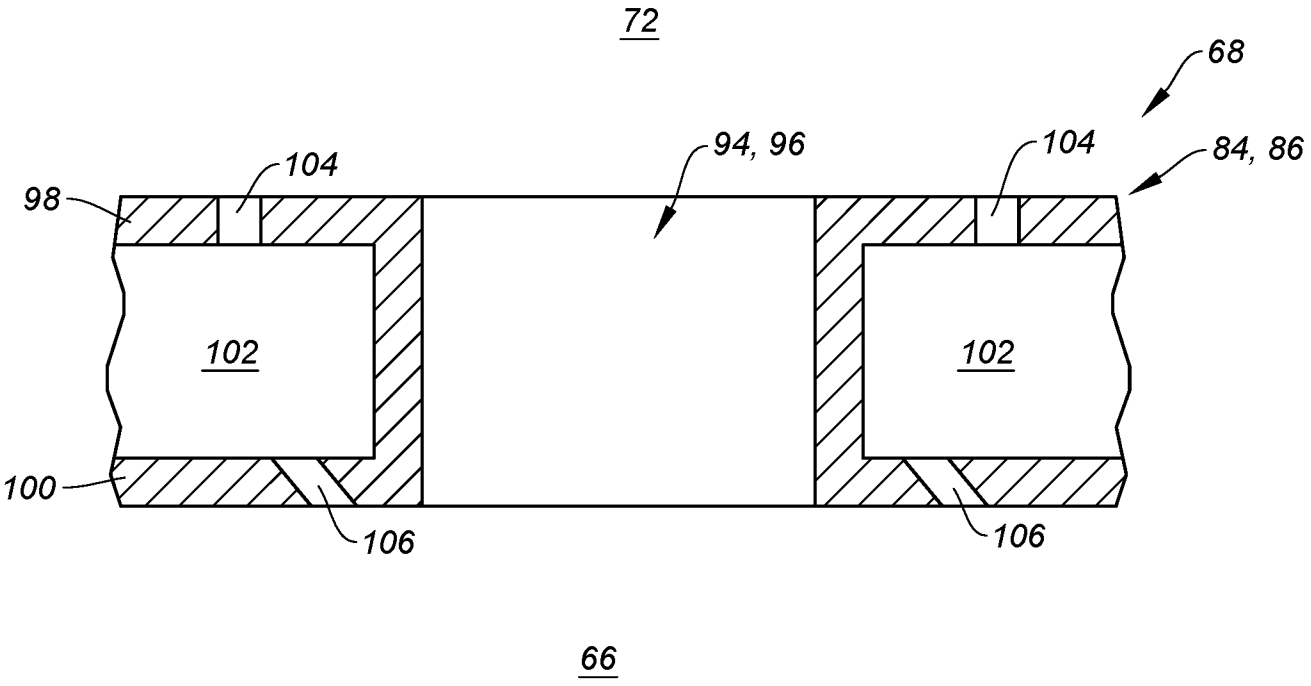
FIG. 4 is a partial sectional illustration of a multi-layered combustor wall.

Each of the combustor walls 84, 86 may be configured as a single layer combustor wall. Alternatively, any one or more of the combustor walls 84 and/or 86 may each be configured as a multi-layer combustor wall; e.g., a hollow, dual-walled structure. For example, referring to FIG. 4, each combustor wall 84, 86 may include a combustor wall shell 98, a combustor wall heat shield 100 (e.g., a liner) and one or more combustor wall cooling cavities 102 (e.g., impingement cavities) formed by and (e.g., radially) between the shell 98 and the heat shield 100. Each cooling cavity 102 may be fluidly coupled with the diffuser plenum 72 through one or more shell cooling apertures 104 in the shell 98; e.g., impingement apertures. Each cooling cavity 102 may be fluidly coupled with the combustion chamber 66 through one or more heat shield cooling apertures 106 in the heat shield 100; e.g., effusion apertures. Here, the dilution apertures 94, 96 are fluidly discrete from the cooling cavities 102, and each of the dilution apertures 94, 96 extends through the both the shell 98 and the heat shield 100; e.g., through an entire thickness of the respective combustor wall 84, 86.

Figure 5:
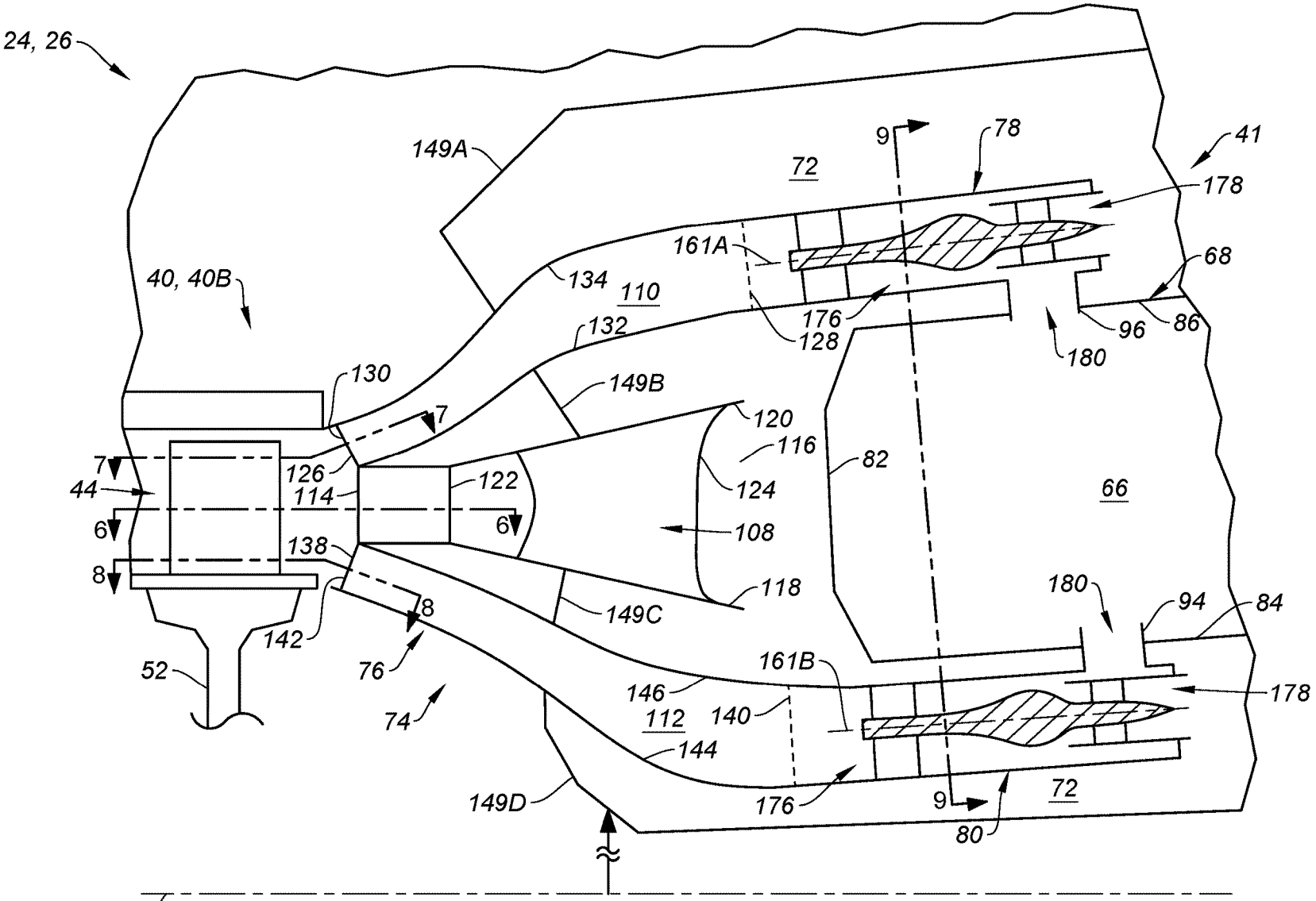
FIG. 5 is a schematic illustration of a portion of the aircraft system at an air separation system.

Referring to FIG. 5, the diffuser structure 76 includes one or more diffuser passages. More particularly, the diffuser structure 76 of FIG. 5 includes at least one (e.g., central) plenum passage 108, one or more outer separator passages 110 and one or more inner separator passages 112.

Figure 6:
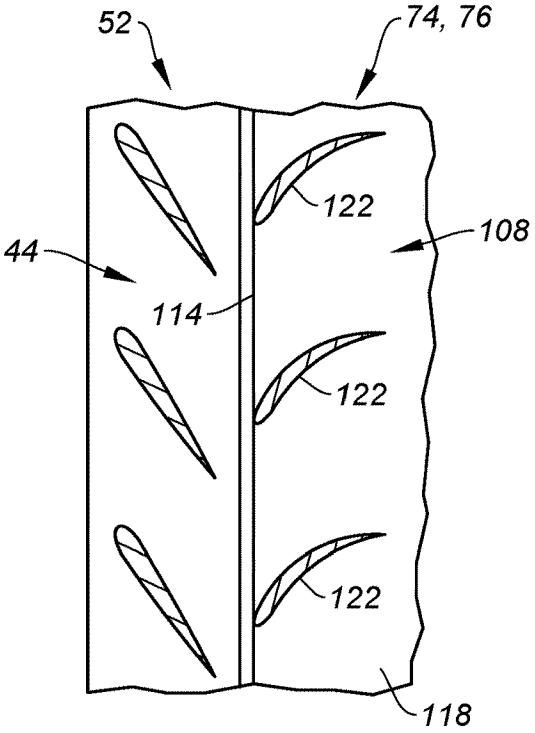
FIG. 6 is a sectional illustration of a portion of the aircraft system taken along line 6-6 in FIG. 5.

The plenum passage 108 is radially offset from each of the outer separator passages 110 and each of the inner separator passages 112. The plenum passage 108 of FIG. 5, for example, is located radially between the outer separator passages 110 and the inner separator passages 112. This plenum passage 108 extends longitudinally from an inlet 114 into the plenum passage 108 to an outlet 116 from the plenum passage 108. The plenum passage inlet 114 of FIG. 5 is disposed downstream of and next to (e.g., adjacent) the HPC rotor 52 and its last downstream compressor stage. The plenum passage outlet 116 of FIG. 5 is disposed upstream of and proximate (e.g., radially aligned with) the combustor 68 and its bulkhead wall 82. The plenum passage 108 extends radially between and to an inner plenum passage wall 118 and an outer plenum passage wall 120. The inner plenum passage wall 118 forms a radial inner peripheral boundary of the plenum passage 108. The outer plenum passage wall 120 forms a radial outer peripheral boundary of the plenum passage 108. The plenum passage 108 also extends circumferentially about (e.g., completely around) the axis 34, for example providing the plenum passage 108 with an annular geometry; see also FIG. 6.

The plenum passage 108 may be configured with one or more guide vanes 122; e.g., compressor exit guide vanes. These guide vanes 122 of FIG. 5 are located within the plenum passage 108 at the plenum passage inlet 114. The guide vanes 122 are arranged and equispaced circumferentially about the axis 34 in an array; e.g., a circular array. Each guide vane 122 extends radially across the plenum passage 108 from the inner plenum passage wall 118 to the outer plenum passage wall 120. Each guide vane 122 is also connected to the inner plenum passage wall 118 and the outer plenum passage wall 120. The guide vanes 122 may be configured to condition the core air leaving the HPC section 40B and entering the diffuser plenum 72. The guide vanes 122, for example, may be configured to remove swirl from the core air imparted by the HPC rotor 52 and its last downstream compressor stage.

The plenum passage 108 may also (or alternatively) be configured with one or more diffuser vanes 124. These diffuser vanes 124 of FIG. 5 are located within the plenum passage 108 at the plenum passage outlet 116. The diffuser vanes 124 are arranged and equispaced circumferentially about the axis 34 in an array; e.g., a circular array. Each diffuser vane 124 extends radially across the plenum passage 108 from the inner plenum passage wall 118 to the outer plenum passage wall 120. Each diffuser vane 124 is also connected to the inner plenum passage wall 118 and the outer plenum passage wall 120. The diffuser vanes 124 may be configured to facilitate diffusion of and deceleration of the core air leaving the plenum passage 108 and entering the diffuser plenum 72.

Figure 7:
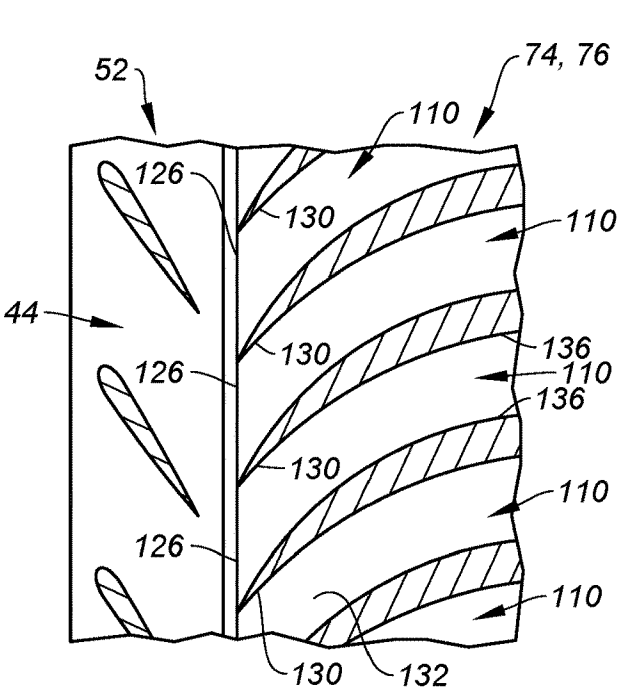
FIG. 7 is a sectional illustration of a portion of the aircraft system taken along line 7-7 in FIG. 5.

The outer separator passages 110 are located radially outboard of the plenum passage 108. The outer separator passages 110 are arranged circumferentially about the axis 34 in an array; e.g., a circular array. This array of outer separator passages 110 circumscribes the plenum passage 108. Each outer separator passage 110 extends longitudinally from an inlet 126 into the respective outer separator passage 110 to an outlet 128 from the respective outer separator passage 110. The outer separator passage inlet 126 of FIG. 5 is disposed downstream of and next to (e.g., adjacent) the HPC rotor 52 and its last downstream compressor stage. This outer separator passage inlet 126 is radially adjacent and outboard of the plenum passage inlet 114. Referring to FIG. 7, each circumferentially neighboring (e.g., adjacent) pair of the outer separator passage inlets 126 may be separated by a respective outer splitter 130; e.g., a diffuser wedge. The outer separator passage outlet 128 of FIG. 5 is disposed upstream of and adjacent a respective one of the outer separators 78. Each outer separator passage 110 extends radially between and to an inner separator passage wall 132 and an outer separator passage wall 134. The inner separator passage wall 132 forms a radial inner peripheral boundary of the respective outer separator passage 110. The outer separator passage wall 134 forms a radial outer peripheral boundary of the respective outer separator passage 110. Referring to FIG. 7, each outer separator passage 110 also extends laterally (e.g., circumferentially partially about the axis 34) between opposing sidewalls 136 of the respective outer separator passage 110.

Figure 8:
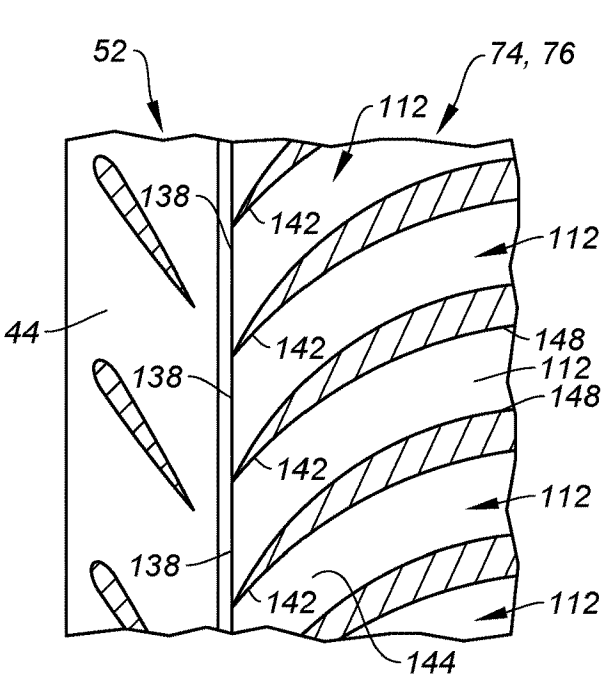
FIG. 8 is a sectional illustration of a portion of the aircraft system taken along line 8-8 in FIG. 5.

The inner separator passages 112 of FIG. 5 are located radially inboard of the plenum passage 108. The inner separator passages 112 are arranged circumferentially about the axis 34 in an array; e.g., a circular array. This array of inner separator passages 112 is circumscribed by the plenum passage 108. Each inner separator passage 112 extends longitudinally from an inlet 138 into the respective inner separator passage 112 to an outlet 140 from the respective inner separator passage 112. The inner separator passage inlet 138 of FIG. 5 is disposed downstream of and next to (e.g., adjacent) the HPC rotor 52 and its last downstream compressor stage. This inner separator passage inlet 138 is radially adjacent and inboard of the plenum passage inlet 114. Referring to FIG. 8, each circumferentially neighboring (e.g., adjacent) pair of the inner separator passage inlets 138 may be separated by a respective inner splitter 142; e.g., a diffuser wedge. The inner separator passage outlet 140 of FIG. 5 is disposed upstream of and adjacent a respective one of the inner separators 80. Each inner separator passage 112 extends radially between and to an inner separator passage wall 144 and an outer separator passage wall 146. The inner separator passage wall 144 forms a radial inner peripheral boundary of the respective inner separator passage 112. The outer separator passage wall 146 forms a radial outer peripheral boundary of the respective inner separator passage 112. Referring to FIG. 8, each inner separator passage 112 also extends laterally (e.g., circumferentially partially about the axis 34) between opposing sidewalls 148 of the respective inner separator passage 112.

With the arrangement of FIG. 5, the outer separator passage wall 134 is split to facilitate formation of a (e.g., full) circumferential diffuser wall 149A. The inner separator passage wall 132 is split to facilitate formation of a (e.g., full) circumferential diffuser wall 149B. This split of the walls 132 and 134 is made upstream of the outer separator passage outlets 128. Similarly, the outer separator passage wall 146 is split to facilitate formation of a (e.g., full) circumferential diffuser wall 149C. The inner separator passage wall 144 is split to facilitate formation of a (e.g., full) circumferential diffuser wall 149D. This split of the walls 144 and 146 is made upstream of the inner separator passage outlets 140.

Figure 9:
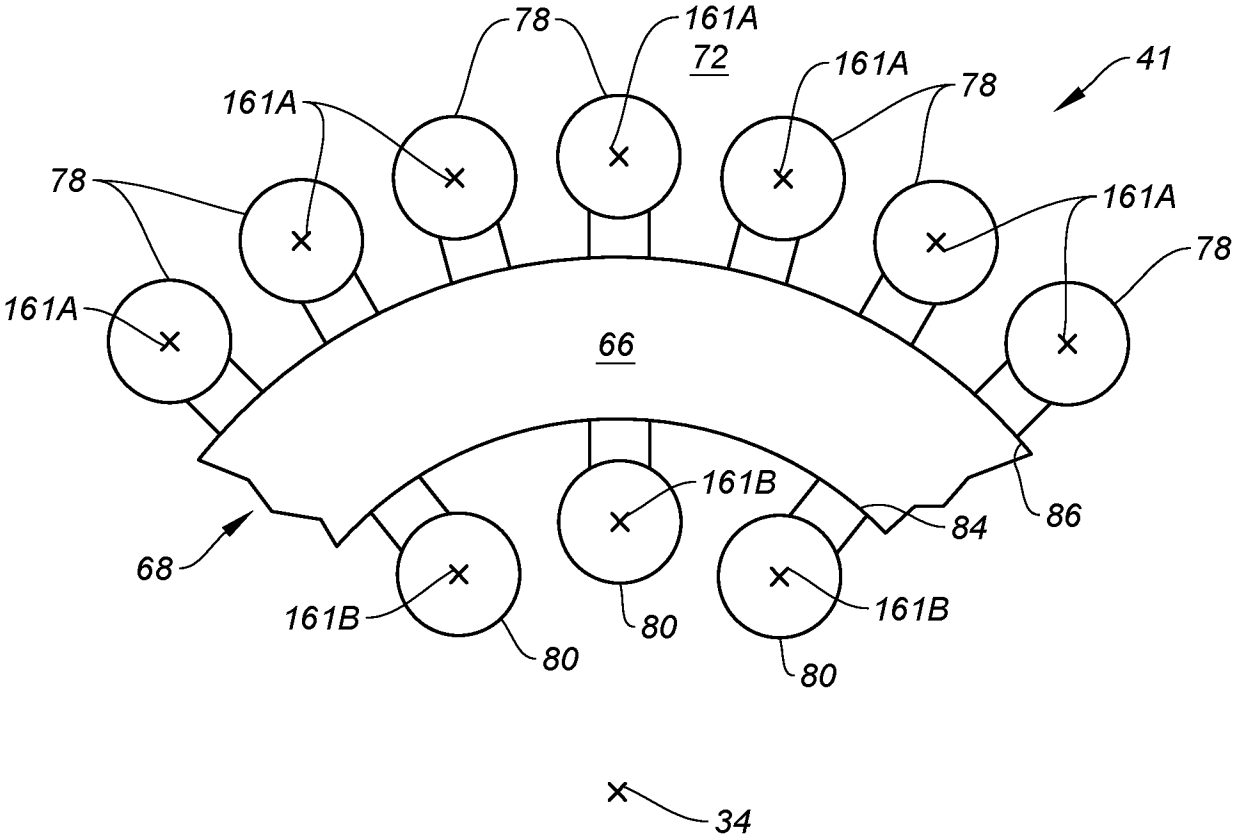
FIG. 9 is a partial schematic illustration of the combustor with multiple air-debris separators taken along line 9-9 in FIG. 5.

The outer separators 78 of FIG. 5 are located in the diffuser plenum 72. The outer separators 78 are located radially outboard of and may be next to the combustor 68 and its outer combustor wall 86. The outer separators 78 are arranged circumferentially about the axis 34 in an array; e.g., a circular array. This array of outer separators 78 circumscribes the combustor 68 and its outer combustor wall 86; see also FIG. 9. Similarly, the inner separators 80 of FIG. 5 are located in the diffuser plenum 72. The inner separators 80 are located radially inboard of and may be next to the combustor 68 and its inner combustor wall 84. The inner separators 80 are arranged circumferentially about the axis 34 in an array; e.g., a circular array. This array of inner separators 80 is circumscribed by the combustor 68 and its inner combustor wall 84; see also FIG. 9.

Figure 10A:
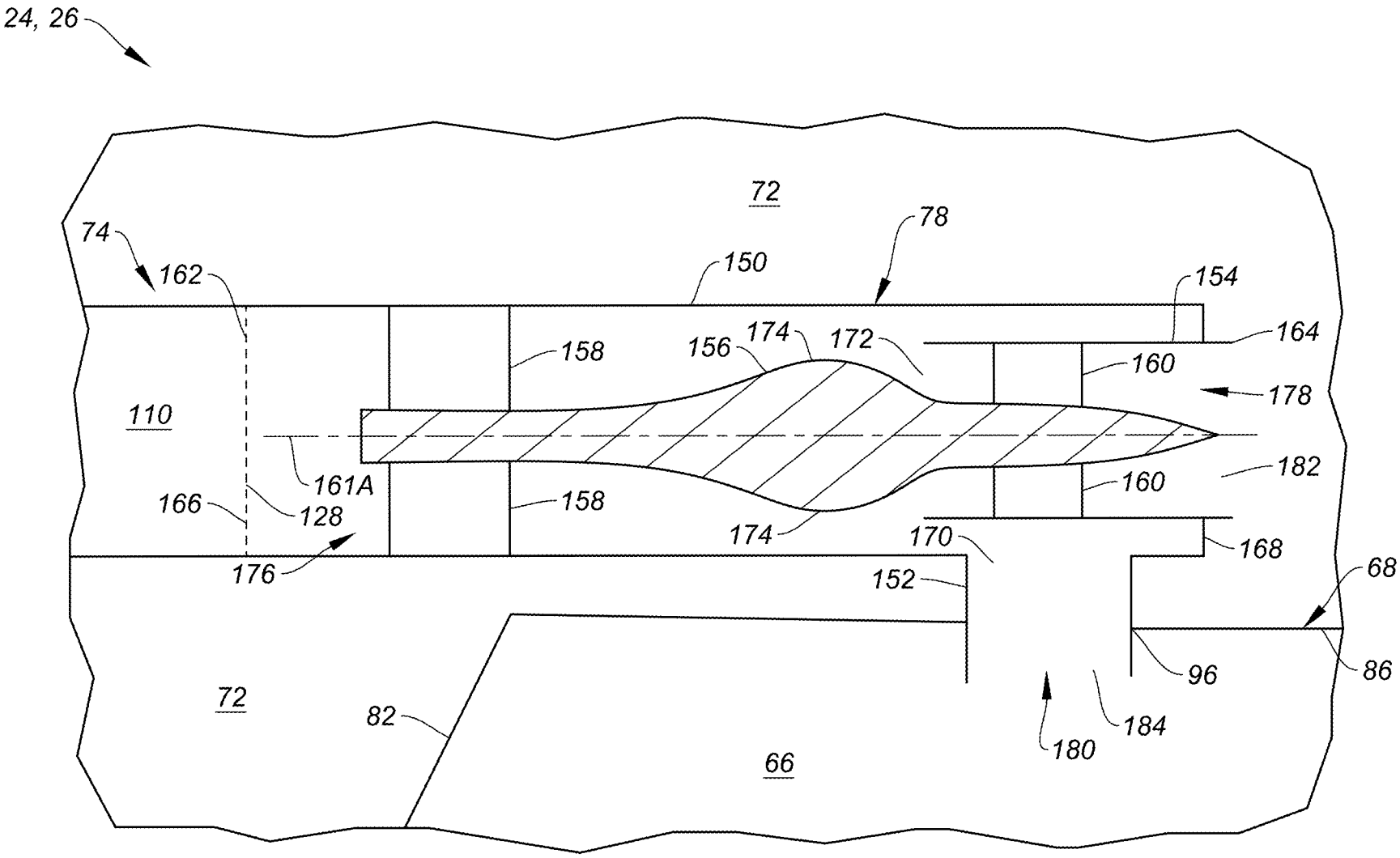
FIG. 10A is a schematic illustration of a portion of the aircraft system at a respective outer air-debris separator.
Figure 10B:
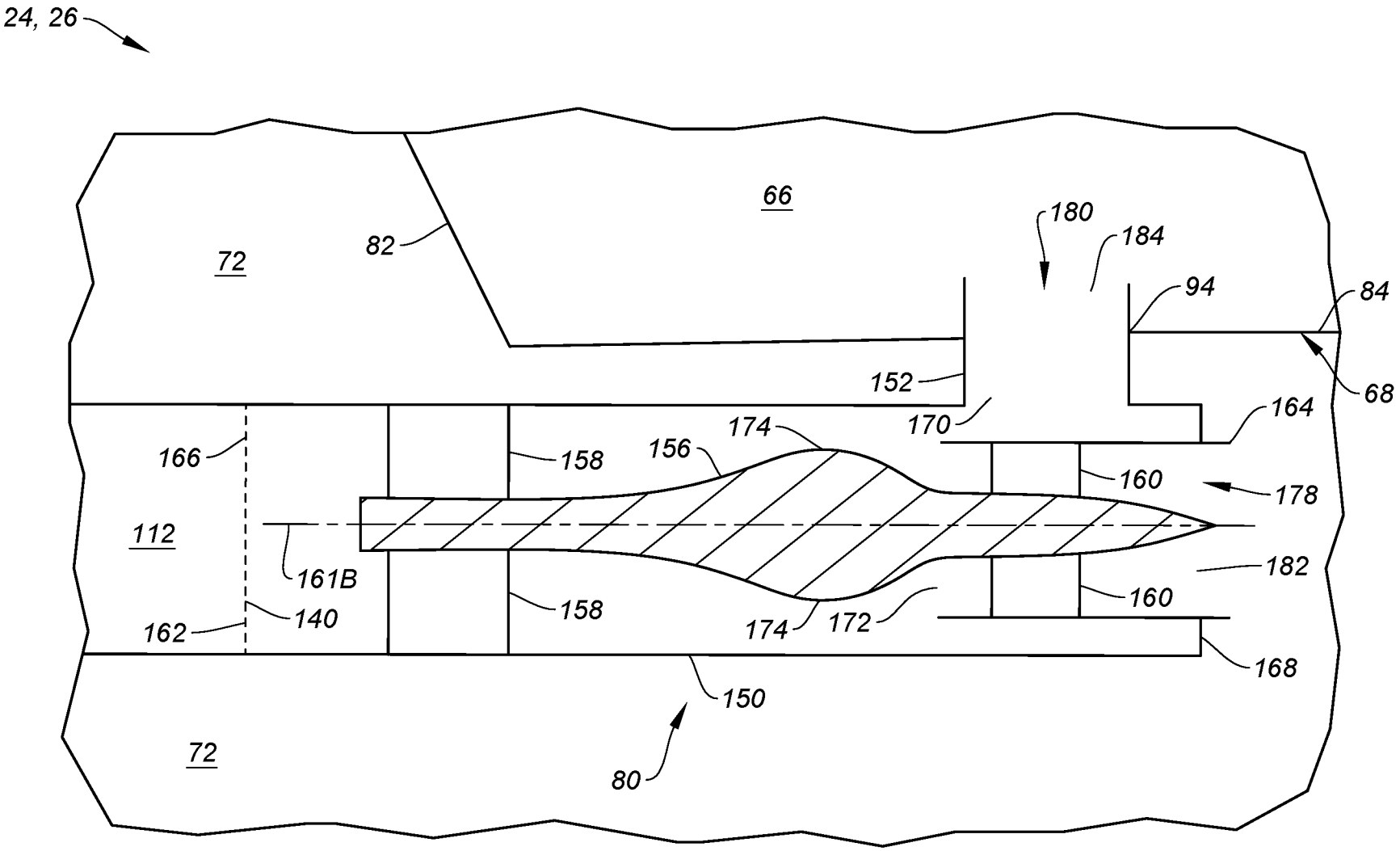
FIG. 10B is a schematic illustration of a portion of the aircraft system at a respective inner air-debris separator.

Referring to FIGS. 10A, 10B, each of the air-debris separators 78, 80 may be configured as a cyclonic separator. Each air-debris separator 78, 80 of FIGS. 10A, 10B, for example, includes an outer tube 150, an outlet tube 152, an inner tube 154 and a center body 156. Each air-debris separator 78, 80 may also include one or more upstream vanes 158 and/or one or more downstream vanes 160.

The outer tube 150 extends longitudinally along a longitudinal centerline 161A, 161B (generally referred to as "161") from an upstream end 162 of the respective air-debris separator 78, 80 to a downstream end 164 of the respective air-debris separator 78, 80. An inner bore of the outer tube 150 extends longitudinally within the outer tube 150 from an inlet 166 into the air-debris separator 78, 80 at the separator upstream end 162 to an endwall 168 at the separator downstream end 164. Here, the separator inlet 166 is fluidly coupled to a respective separator passage outlet.

The outlet tube 152 is disposed outside of and is connected to the outer tube 150. The outlet tube 152 of FIGS. 10A, 10B, for example, projects radially out from a sidewall of the outer tube 150 towards the combustor 68 and to a respective one of the dilution apertures 94, 96. Here, an inner bore of the outlet tube 152 fluidly couples the inner bore of the outer tube 150 to the respective dilution aperture 94, 96 and, thus, the combustion chamber 66 through the respective dilution aperture 94, 96.

The inner tube 154 is disposed partially (or completely) within the inner bore of the outer tube 150. The inner tube 154 of FIGS. 10A, 10B, for example, projects longitudinally along the longitudinal centerline 161 through the separator endwall 168 and into the inner bore of the outer tube 150. Within the inner bore of the outer tube 150, a sidewall of the inner tube 154 may axially overlap (e.g., an entirety of) an inlet 170 into the inner bore of the outlet tube 152. Here, an inner bore of the inner tube 154 fluidly couples the inner bore of the outer tube 150 to the diffuser plenum 72.

The center body 156 is disposed within the inner bore of the outer tube 150 and the inner bore of the inner tube 154. An upstream portion of the center body 156, for example, is centered within and extends longitudinally within the inner bore of the outer tube 150. A downstream portion of the center body 156 is centered within and extends longitudinally within the inner bore of the inner tube 154. More particularly, the downstream portion of the center body 156 projects longitudinally along the longitudinal centerline 161 out from the outer tube 150 and into the inner tube 154 partially towards the respective separator downstream end 164. In the embodiments of FIG. 10, a portion of the center body 156 and its upstream portion at and/or upstream of an inlet 172 into the inner bore of the inner tube 154 may include an annular convexity 174 (e.g., a hump) which projects radially out towards, but is spaced from, the sidewall of the outer tube 150.

The upstream vanes 158 are disposed within the inner bore of the outer tube 150. These upstream vanes 158 are arranged circumferentially about the center body 156 in an array; e.g., a circular array. Each of the upstream vanes 158 may project radially out from the center body 156 to the sidewall of the outer tube 150. These upstream vanes 158 may thereby connect the center body 156 to the outer tube 150. In addition, the upstream vanes 158 may be configured to impart (e.g., additional) swirl to air flowing within the inner bore of the outer tube 150.

The downstream vanes 160 are disposed within the inner bore of the inner tube 154. These downstream vanes 160 are arranged circumferentially about the center body 156 in an array; e.g., a circular array. Each of the downstream vanes 160 may project radially out from the center body 156 to the sidewall of the inner tube 154. These downstream vanes 160 may thereby connect the center body 156 to the inner tube 154. In addition, the downstream vanes 160 may be configured to condition (e.g., de-swirl, straighten out) the swirling air received from the inner bore of the outer tube 150.

With the air-debris separator arrangement of FIGS. 10A, 10B, each air-debris separator 78, 80 includes an inlet airflow passage 176, a clean airflow passage 178 and a dirty airflow passage 180. The inlet airflow passage 176 extends longitudinally within the outer tube 150 from the separator inlet 166, along the center body 156, to a distal interior end of the inner tube 154. The clean airflow passage 178 extends longitudinally from the inlet airflow passage 176, through the inner tube 154 and along center body 156, to a clean airflow outlet 182 from the respective air-debris separator 78, 80. This clean airflow outlet 182 is fluidly coupled with the diffuser plenum 72. An upstream portion of the dirty airflow passage 180 is formed radially between the inner tube 154 and the outer tube 150, and is fluidly coupled with the inlet airflow passage 176. A downstream portion of the dirty airflow passage 180 extends from the upstream portion of the dirty airflow passage 180, through the outlet tube 152, to a dirty airflow outlet 184 from the respective air-debris separator 78, 80. Each air-debris separator 78, 80 may thereby fluidly couple a respective one of the separator passages 110, 112 to a respective one of the dilution aperture 94, 96 and the diffuser plenum 72.

During operation of the air separation system 74 of FIG. 5, each of the diffuser passages 108, 110, 112 receives compressed core air from the HPC section 40B. Under certain conditions, this core air may include debris such as, but not limited to, dirt, sand or other foreign particulate matter ingesting into the turbine engine 26. The compression of the core air may tend to push the debris to one or more of the radial peripheral boundaries of the core flowpath 44. Thus, the plenum passage 108 may tend to receive relatively clean air (e.g., compressed core air with little or no debris), whereas the separator passages 110 and 112 may tend to receive dirty air (e.g., compressed core air with entrained debris), particularly the outer separator passages 110. The plenum passage 108 directs the clean air (e.g., directly) into the diffuser plenum 72. By contrast, each separator passage 110, 112 directs the dirty air to a respective one of the air-debris separators 78, 80. Referring to FIGS. 10A, 10B, within each air-debris separator 78, 80, the incoming (e.g., dirty) air is swirled around the center body 156, which swirl may be imparted from the HPC rotor 52 (see FIG. 5) and/or the upstream vanes 158 (when included). This swirling may cause the relatively heavy debris to move towards/to the sidewall of the outer tube 150 while the lighter clean air may flow closer to and along the center body 156. The debris along with a portion of the core air flows into the dirty airflow passage 180, and the dirty airflow passage 180 directs that dirty air into the combustion chamber 66 through the respective dilution aperture 94, 96. The clean air, by contrast, flows into the clean airflow passage 178 and is directed into the diffuser plenum 72. With this arrangement, the dirty air and its debris is directed through a relatively large openings—the respective dilution apertures 94, 96. The clean air, on the other hand, may flow through smaller apertures/passages (e.g., combustor wall cooling apertures). Since the clean air includes little or no debris, the foregoing separation of the debris may reduce likelihood of debris accumulating on an engine component and clogging its relatively small apertures/passages as used for cooling the downstream circumferential stator vane array 90 (e.g., a turbine inlet nozzle) in the HPT section 42A.

The air separation system 74 of FIG. 5 is described above with both the outer and the inner separator passages 110 and 112 as well as the outer and the inner separators 78 and 80. In other embodiments, however, it is contemplated one or more or all of the inner separator passages 112 and the associated inner separators 80 may be omitted. In still other embodiments, however, it is contemplated one or more or all of the outer separator passages 110 and the associated outer separators 78 may be omitted.

In a typical high pressure compressor section, its high pressure compressor rotor may be configured to compress the core air while concurrently reducing a Mach number speed of the core air such that compressed core air entering a diffuser plenum is relatively slow. However, since the air separation system 74 of FIG. 5 may take advantage higher speed core air to facilitate flow and swirl through the air-debris separators 78 and 80, the HPC rotor 52 may be configured to compress the core air while maintaining a certain Mach number speed of the core air. The HPC rotor 52, for example, may be configured such that the core air is directed into one or more of the diffuser passages 108, 110 and/or 112 with a Mach number equal to or greater than 0.5 Mach; e.g., equal to or greater than 0.55 Mach. With this arrangement, the core air directed into the diffuser plenum 72 through the plenum passage 108 may have a Mach number at the plenum passage outlet 116 equal to or greater than 0.2 Mach; e.g., equal to or greater than 0.25 Mach.

While the air separation system 74 is described above as directing the dirty air with the debris into the combustion chamber 66, it is contemplated this dirty air may also or alternatively be routed to other destinations. For example, the air separation system 74 may be configured to also (or alternatively) vent the dirty air outside of the engine core 24; e.g., into a bypass flowpath.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for a turbine engine, comprising:

an engine core extending along an axis, the engine core including a compressor section, a combustor, a diffuser structure, a diffuser plenum, a first separator, and a second separator, the compressor section comprising a compressor rotor, wherein the first separator includes a center body, an inner tube, an outer tube, an outlet tube, a first airflow passage, and a second airflow passage;

the combustor arranged within the diffuser plenum, the combustor including a combustion chamber extending radially between a first combustor wall and a second combustor wall, the first combustor wall and the second combustor wall being disposed between the combustion chamber and the diffuser plenum, the first combustor wall comprising a first dilution aperture extending through the first combustor wall to the combustion chamber, and the second combustor wall comprising a second dilution aperture extending through the second combustor wall to the combustion chamber;

the diffuser structure including a first diffuser passage, a second diffuser passage disposed radially outboard of the first diffuser passage, and a third diffuser passage disposed radially inboard of the first diffuser passage, the first diffuser passage fluidly coupling the compressor section to the diffuser plenum, the second diffuser passage fluidly coupling the compressor section to the first separator, the third diffuser passage fluidly coupling the compressor section to the second separator, the second diffuser passage extending longitudinally from an inlet of the second diffuser passage to an outlet of the second diffuser passage, the inlet of the second diffuser passage downstream of and adjacent the compressor rotor, and the outlet of the second diffuser passage interfacing with the outer tube at a separator inlet of the first separator;

the outlet tube of the first separator extending from the outer tube and through the first dilution aperture, and fluidly coupling the outer tube with the combustion chamber; and the first separator fluidly coupling the second diffuser passage to the first dilution aperture, and the second separator fluidly coupling the third diffuser passage to the second dilution aperture.

2. The assembly of claim 1, wherein the engine core further includes a turbine section comprising a circumferential stator vane array; and the first combustor wall is connected to the circumferential stator vane array.

3. The assembly of claim 1, wherein the first separator is arranged within the diffuser plenum radially next to the first combustor wall.

4. The assembly of claim 1, wherein the first separator comprises a cyclonic separator.

5. The assembly of claim 1, wherein the first separator is configured to separate compressed core air received from the compressor section into a first airflow and a second airflow;

the first separator is configured to direct the first airflow into the diffuser plenum; and the first separator is configured to direct the second airflow into the combustion chamber through the first dilution aperture.

6. The assembly of claim 5, wherein, when the compressed core air received by the first separator from the compressor section includes debris, the first separator is configured to divert at least a majority of the debris away from the first airflow and into the second airflow to flow with the second airflow into the combustion chamber through the first dilution aperture.

7. The assembly of claim 1, wherein an upstream portion of the center body extends longitudinally in a bore of the outer tube, and a downstream portion of the center body projects longitudinally into a bore of the inner tube;

the outer tube extends longitudinally along and circumscribes the inner tube;

the first airflow passage is formed within the inner tube; and the second airflow passage is formed between the inner tube and the outer tube, and the second airflow passage is fluidly coupled to the first dilution aperture.

8. The assembly of claim 1, wherein the first airflow passage is fluidly coupled to the diffuser plenum.

9. The assembly of claim 1, wherein the first separator further includes one or more vanes connecting the center body to the outer tube.

10. The assembly of claim 1, wherein the first separator further includes one or more vanes connecting the center body to the inner tube.

11. The assembly of claim 1, wherein the first diffuser passage comprises an annular passage; and the second diffuser passage is a non-annular passage.

12. The assembly of claim 1, wherein the engine core further includes a third separator;

the first combustor wall further comprises a third dilution aperture extending through the first combustor wall to the combustion chamber;

the diffuser structure further includes a fourth diffuser passage radially offset from the first diffuser passage and radially aligned with the second diffuser passage, and the fourth diffuser passage fluidly couples the compressor section to the third separator; and the third separator fluidly couples the fourth diffuser passage to the third dilution aperture.

13. The assembly of claim 1, wherein the compressor section comprises an axial flow compressor rotor upstream of and next to the diffuser structure.

14. A method of operating the turbine engine assembly of claim 1, comprising:

compressing core air with the compressor section to provide compressed core air;

directing a first portion of the compressed core air into the diffuser plenum;

directing a second portion of the compressed core air into the first separator;

separating the second portion of the compressed core air within the first separator into a first airflow and a second airflow carrying debris;

directing the first airflow out of the first separator through the first diffuser passage into the diffuser plenum; and directing the second airflow carrying the debris out of the first separator through the second diffuser passage into the combustion chamber within the combustor.

15. The assembly of claim 1, wherein:

the first airflow passage is fluidly coupled to the diffuser plenum;

the second separator includes a second center body, a second inner tube, a second outer tube, a third airflow passage, and a fourth airflow passage;

the third airflow passage is formed within the second inner tube, and the third airflow passage is fluidly coupled with the diffuser plenum; and the fourth airflow passage is formed between the second inner tube and the second outer tube, and the fourth airflow passage is fluidly coupled to the second dilution aperture.

16. The assembly of claim 1, wherein the outlet tube projects radially inward from a sidewall the outer tube.

* * * * *